US010029141B2

(12) United States Patent
Lagree

(10) Patent No.: US 10,029,141 B2
(45) **Date of Patent: *Jul. 24, 2018**

(54) EXERCISE MACHINE HANDLE INDICIA SYSTEM

(71) Applicant: Lagree Technologies, Inc., Burbank, CA (US)

(72) Inventor: Sebastien Anthony Louis Lagree, Burbank, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/418,134

(22) Filed: Jan. 27, 2017

(65) Prior Publication Data

US 2017/0157452 A1 Jun. 8, 2017

Related U.S. Application Data

(63) Continuation-in-part of application No. 15/299,333, filed on Oct. 20, 2016, now Pat. No. 9,981,156.
(Continued)

(51) Int. Cl.
*A63B 26/00* (2006.01)
*A63B 21/00* (2006.01)
(Continued)

(52) U.S. Cl.
CPC ..... *A63B 21/4035* (2015.10); *A63B 21/023* (2013.01); *A63B 21/068* (2013.01);
(Continued)

(58) Field of Classification Search
CPC ..... A63B 21/1465; A63B 21/1469
(Continued)

(56) References Cited

U.S. PATENT DOCUMENTS 2,223,309 A 11/1940 Swanson
3,770,267 A 11/1973 McCarthy
(Continued)

OTHER PUBLICATIONS

PCT International Search Report and Written Opinion; dated Jan. 13, 2017.
(Continued)

*Primary Examiner* — Loan H Thanh
*Assistant Examiner* — Rae Fischer
(74) *Attorney, Agent, or Firm* — Neustel Law Offices

(57) ABSTRACT

An exercise machine handle indicia system for facilitating efficient and proper exercise movements by an exerciser. The exercise machine handle indicia system generally includes a frame, a carriage movably positioned upon the frame, a bias member connected between the carriage and the frame that applies a bias force upon the carriage, and a first handle and a second handle connected to the frame near the first end of the frame. The first handle includes a first indicia to indicate where to position a first hand of an exerciser to perform a first exercise and the second handle includes a first indicia to indicate where to position a second hand of the exerciser to perform the first exercise. During the performance of an exercise, the exerciser is instructed by a human instructor or an electronic device which indicia on the handles to position their hands or other body parts.

20 Claims, 7 Drawing Sheets

Related U.S. Application Data

(60) Provisional application No. 62/244,275, filed on Oct. 21, 2015, provisional application No. 62/287,715, filed on Jan. 27, 2016.

(51) Int. Cl.

| | |
|---|---|
| ***A63B 21/02*** | (2006.01) |
| ***A63B 71/06*** | (2006.01) |
| ***A63B 21/068*** | (2006.01) |
| ***A63B 23/04*** | (2006.01) |
| ***A63B 23/02*** | (2006.01) |
| ***A63B 23/12*** | (2006.01) |

(52) U.S. Cl.
CPC ..... *A63B 21/4045* (2015.10); *A63B 23/0233* (2013.01); *A63B 23/04* (2013.01); *A63B 23/12* (2013.01); *A63B 71/0622* (2013.01); *A63B 2071/0602* (2013.01); *A63B 2071/0694* (2013.01)

(58) Field of Classification Search
USPC ..... 482/62
See application file for complete search history.

(56) References Cited

U.S. PATENT DOCUMENTS

| | | | | |
|---|---|---|---|---|
| 3,795,396 | A | 3/1974 | Kropelnitski | |
| 4,231,375 | A | 11/1980 | Boehringer | |
| 4,620,701 | A | 11/1986 | Mojden | |
| 4,709,920 | A | 12/1987 | Schnell | |
| 5,066,005 | A | 11/1991 | Luecke | |
| 5,139,471 | A | 8/1992 | Dornberger | |
| 5,374,226 | A | 12/1994 | Grahm | |
| 5,380,259 | A | 1/1995 | Robertson | |
| 5,857,946 | A | 1/1999 | Brown | |
| 6,315,695 | B1 | 11/2001 | Follett | |
| 6,652,425 | B1 | 11/2003 | Martin | |
| 7,163,500 | B2 | 1/2007 | Endelman | |
| 7,803,095 | B1 | 9/2010 | Lagree | |
| 7,819,777 | B1 | 10/2010 | Service | |
| 7,942,799 | B1 | 5/2011 | Boyd | |
| D659,205 | S | 5/2012 | Endelman | |
| 8,641,585 | B2 * | 2/2014 | LaGree | A63B 21/023 482/92 |
| 9,119,989 | B1 * | 9/2015 | Lagree | A63B 21/4001 |
| 2003/0119635 | A1 | 6/2003 | Arbuckle | |
| 2010/0227748 | A1 | 9/2010 | Campanaro | |
| 2012/0295771 | A1 | 11/2012 | Lagree | |
| 2013/0017935 | A1 | 1/2013 | Endelman | |
| 2013/0281269 | A1 | 10/2013 | Gerschefske | |
| 2014/0011645 | A1 | 1/2014 | Johnson | |
| 2014/0121076 | A1 | 5/2014 | Lagree | |
| 2014/0121078 | A1 | 5/2014 | Lagree | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |

OTHER PUBLICATIONS

"Can you handle the Supraformer?"(@LAGREEFITNESS) Aug. 24, 2015; (retrieved on Aug. 12, 2016) https://twitter.com/LagreeFitness/status/635822521997242369.

"Los Angeles: Get ready for a one of kind workout!" (@LAGREEFITNESS) Aug. 26, 2015; (retreived Aug. 12, 2016) https://twitter.com/LagreeFitness/status/636555280218615808.

Picture of a product developed by the inventor, Sebastien Lagree, in 2007.

* cited by examiner

EXERCISE MACHINE HANDLE INDICIA SYSTEM

CROSS REFERENCE TO RELATED APPLICATIONS

The present application is a continuation-in-part of U.S. application Ser. No. 15/299,333 filed on Oct. 20, 2016, which claims priority to U.S. Provisional Application No. 62/244,275 filed Oct. 21, 2015. The present application is also a continuation-in-part of U.S. application Ser. No. 14/065,851 filed Oct. 29, 2013, which claims priority to U.S. Provisional Application No. 61/719,763 filed Oct. 29, 2012 and U.S. Provisional Application No. 61/806,655 filed Mar. 29, 2013. The present application also claims priority to U.S. Provisional Application No. 62/287,715 filed Jan. 27, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine handle indicia system for facilitating efficient and proper exercise movements by an exerciser.

Related Art

Any discussion of the related art throughout the specification should in no way be considered as an admission that such related art is widely known or forms part of common general knowledge in the field.

One objective of a fitness trainer is to efficiently use the available time during a training session so that the exercisers maintain a consistent level of effort with minimum resting periods. Therefore, the task of a trainer can be challenging, especially when attempting to instruct many participants in an exercise class to simultaneously assume a proper position at the beginning of an exercise. In such a class setting, one-on-one instruction between the trainer and an exerciser is discouraged because one-on-one instruction interrupts the class instruction and diminishes the benefit of the session to all other participants.

Therefore, instructors have long adopted certain verbal instructions that can be easily followed by a class of participants. For instance, in the performance of a floor pushup, the instructor may direct exercisers to: a) lie prone on the floor, b) place your hands under your shoulders with fingers pointing forward, c) keeping your back locked in a straight position, push your upper body off the color by pushing against the floor with your hands, and d) lower yourself back to the starting position.

On the other hand, interfacing with complex exercise machines providing for many different positions can be intimidating to new exercisers on the machine. As the complexity of exercise equipment increases, and with a corresponding increase in the number of different hand gripping positions on a machine, there is created an increased need to incorporate clear, purpose-driven visual indicators on the machine to which a trainer can quickly refer to while instructing a multitude of exercisers.

SUMMARY

An example embodiment is directed to an exercise machine handle indicia system. The exercise machine handle indicia system includes a frame, a carriage movably positioned upon the frame, a bias member connected between the carriage and the frame that applies a bias force upon the carriage, and a first handle and a second handle connected to the frame near the first end of the frame. The first handle includes a first indicia to indicate where to position a first hand of an exerciser to perform a first exercise and the second handle includes a first indicia to indicate where to position a second hand of the exerciser to perform the first exercise. During the performance of an exercise, the exerciser is instructed by a human instructor or an electronic device which indicia on the handles to position their hands or other body parts.

There has thus been outlined, rather broadly, some of the embodiments of the exercise machine handle indicia system in order that the detailed description thereof may be better understood, and in order that the present contribution to the art may be better appreciated. There are additional embodiments of the exercise machine handle indicia system that will be described hereinafter and that will form the subject matter of the claims appended hereto. In this respect, before explaining at least one embodiment of the exercise machine handle indicia system in detail, it is to be understood that the exercise machine handle indicia system is not limited in its application to the details of construction or to the arrangements of the components set forth in the following description or illustrated in the drawings. The exercise machine handle indicia system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

An example exercise machine handle indicia system generally comprises a frame, a carriage movably positioned upon the frame, a bias member connected between the carriage and the frame that applies a bias force upon the carriage, and a first handle and a second handle connected to the frame near the first end of the frame. The first handle includes a first indicia to indicate where to position a first hand of an exerciser to perform a first exercise and the second handle includes a first indicia to indicate where to position a second hand of the exerciser to perform the first exercise. During the performance of an exercise, the exerciser is instructed by a human instructor or an electronic device which indicia on the handles to position their hands or other body parts.

Figure 1:
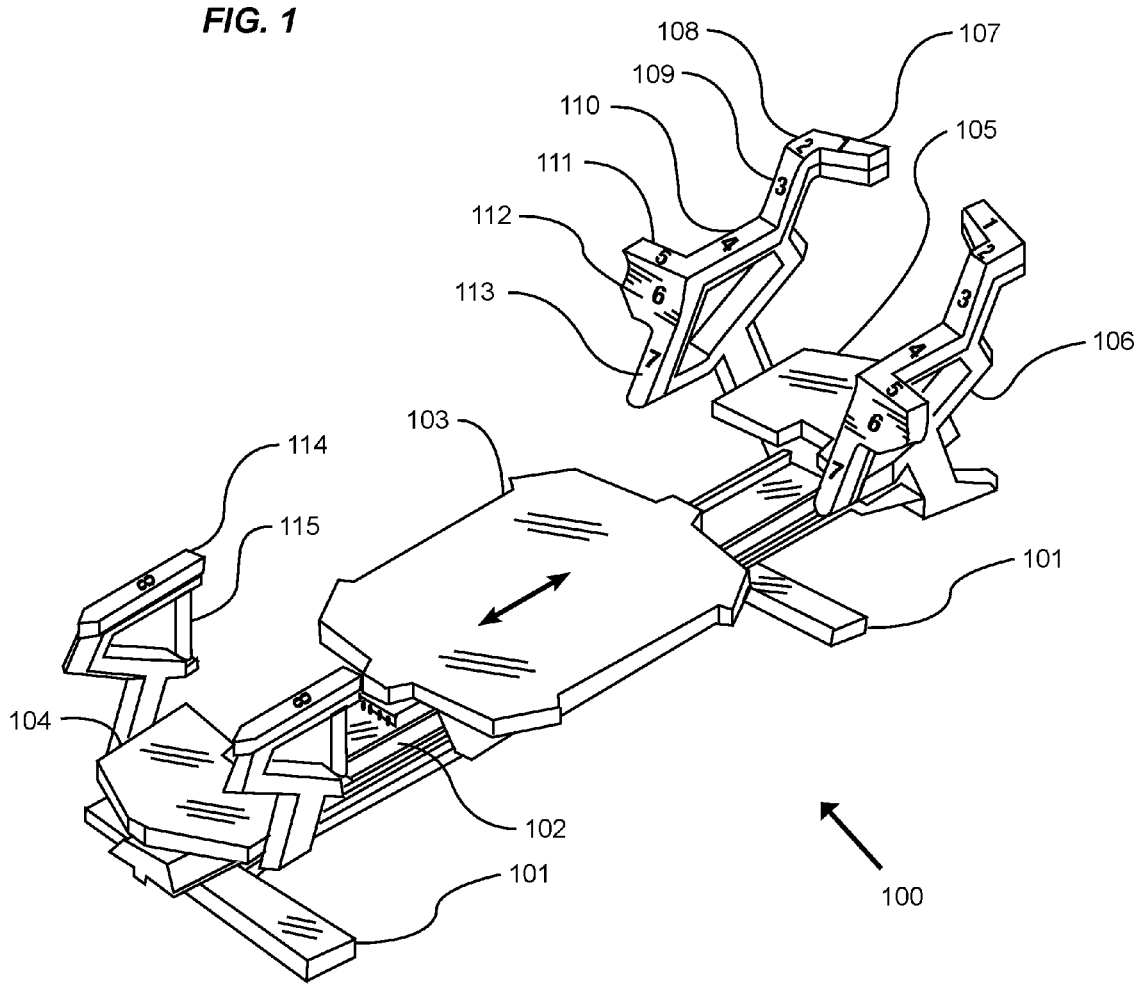
FIG. 1 is a perspective view of an exercise machine handle indicia system in accordance with an example embodiment.

FIG. 1 is an exemplary diagram showing a perspective view of an improved exercise machine 100 with a plurality of hand gripping positions. More specifically, an exercise machine 100 is shown comprising a support structure 101 providing stability for the machine 100 when placed on a floor in an exercise studio. One or more rails 102 extending substantially the length of the machine 100 provides support for an exercise platform 103 slidable substantially between a first stationary end platform 104 and a second stationary end platform 105 affixed to the support structure 101. A spring biasing means not shown provides for a resistance force to be exerted upon the slidable platform 103, biasing the platform 103 towards the end of the machine 100 to which the spring biasing means is attached.

During exercise, an exerciser must grab one or more of a plurality of handles as a means to safely mount the machine, and further as a means to support and stabilize their body during exercise. For each upper body exercise, there is a correct position for the hands and incorrect position of the hands during exercise. The incorrect hand position at the start of an exercise can result in injury to joints, muscles, tendons or ligaments. The exercise machine 100 shows one or more pairs of handles, each pair consisting of one handle on one side of the machine. In addition, a mirror version of those handles may be used on the opposing end of the exercise machine 100.

As a means to aid in visually identifying each of the pairs of handles, small numbers, numbering 1 through 8 are shown on each of the handles. In practice, a fitness trainer will instruct a class of exercisers to grasp a specific handle in preparation for the exercise that will imminently be performed by the exercisers.

A first pair of handles 107 is positioned upon support stanchions 106, the longitudinal axis of the handles 107 extending inward towards the central longitudinal axis of the machine 100 and being substantially transverse to the longitudinal axis of the machine 100. A second pair of handles 108 is shown with the longitudinal axis of the handle 108 being substantially aligned to the longitudinal axis of the machine 100. A third pair of handles 109 is shown with the longitudinal axis of the handle 109 being substantially vertical with respect to the horizontal plane of the exercise platforms 103, 104, 105. A forth pair of handles 110 is shown with the longitudinal axis of the handle 110 being substantially aligned to the longitudinal axis of the machine 100. A fifth pair of handles 111 is shown extending laterally with respect to central longitudinal axis of the machine 100 and being substantially transverse to the longitudinal axis of the machine 100. A sixth pair of handles 112 is shown as a substantially vertical hand and foot platform extending laterally with respect to central longitudinal axis of the machine 100 and being substantially transverse to the longitudinal axis of the machine 100. A seventh pair of handles 113 is shown with the longitudinal axis of the handle 113 being substantially vertical with respect to the horizontal plane of the exercise platforms 103, 104, 105.

Further, an eighth pair of handles 114 is shown with the longitudinal axis of the handle 114 being substantially aligned with respect to the central longitudinal axis of the exercise machine 100. Yet a ninth pair of handles 115 is shown with the longitudinal axis of the handle 115 being substantially vertical with respect to the horizontal plane of the exercise platforms 103, 104, 105.

As can be readily seen, the vast number of handles provided on the improved exercise machine 100 each have a particular use during exercise, and more specifically, the various orientations of the central axes of the handles, and the placement of the handles are determined so as to minimize joint muscle or soft tissue injury of the exerciser while performing exercises during an instructed exercise class.

FIG. 1 further provides an example exercise machine with multiple contact surfaces generally comprises a frame, a carriage movably attached to the rail, and a first support structure and a second support structure attached to the frame near the first end. The support structures each include one or more platforms having an upper surface that is positioned above the base plane of the carriage.

As shown in an embodiment of the invention in FIG. 1, the exercise machine generally comprises a substantially longitudinal rail structure supported by a plurality of fee, a first stationary platform substantially at a first end, a second stationary platform positioned substantially at a distal second end, and a slidable carriage slidably attached to the rail structure, and slidable substantially the length of the apparatus between the first and second stationary platforms. The rail structure may be comprised of a single monorail structure as illustrated in the drawings or two parallel rails.

Not shown, but contained within the interior of the rail structure, one or more biasing members (e.g. springs, elastic cords) are removably attachable between a first end of the apparatus and the slidable carriage, thereby exerting a biasing force on the carriage. An exerciser performs resistance exercises on the apparatus by moving the carriage in a direction opposed to the biasing members. U.S. Pat. No. 7,803,095 to Lagree illustrates an exemplary exercise apparatus suitable for use as the base structure for the present invention and is hereby incorporated by reference in its entirety herein.

In the drawing, a supporting base with feet is shown supporting an exercise apparatus. A first stationary platform is shown positioned between a pair of stanchions that support a plurality of supporting platforms and handles.

A plurality of secondary support platforms and gripping handles are shown, specifically a left and right platform and handle system positioned substantially at the second end of the apparatus. A plurality of secondary support platforms and gripping handles are shown, specifically a left and right platform and handle system positioned substantially at the second end of the apparatus the platform and handle systems supported by stanchions affixed to the support structure.

Further, a left and right platform and handle system substantially positioned at the first end of the apparatus, each handle system comprising an upper horizontal platform and handle, an upper gripping handle angled downwardly at an acute angle to the Z axis, a lower horizontal platform and handle aligned with the Y axis, a lower handle extending laterally therefrom substantially aligned with the X axis, a leg press platform, and a lower gripping handle aligned at an acute angle to the Z axis.

More specifically, the platform handle assemblies comprise an upper horizontal platform and handle projecting substantially medially towards the longitudinal center line and substantially aligned with the X axis, a lower handle extending laterally therefrom substantially aligned with the X axis, and a leg press platform projecting laterally therefrom substantially aligned with the X axis.

Figure 2:
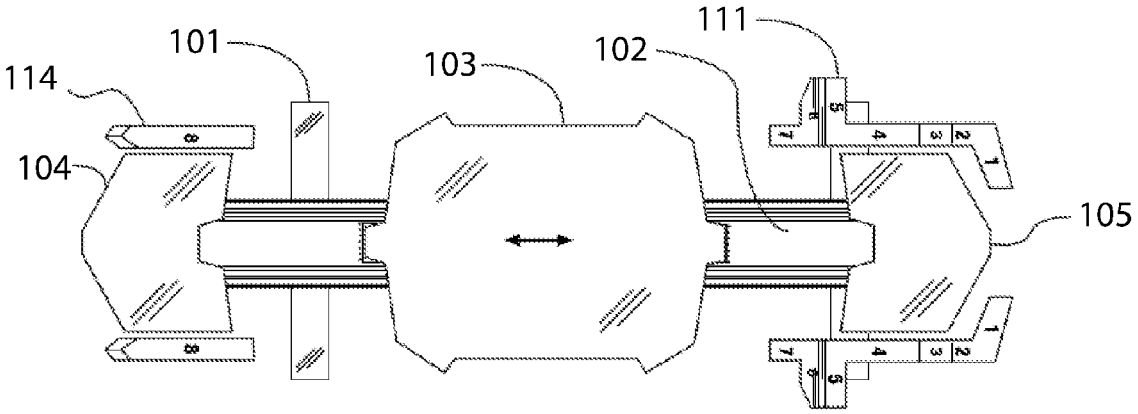
FIG. 2 is a top view of an exercise machine handle indicia system in accordance with an example embodiment.

FIG. 2 is an exemplary diagram showing a top view of an improved exercise machine. For efficiency, and so as to not unduly repeat each and every handle or pairs of handles just described, only a few elements previously described are called out as a means to provide a clearer understanding of the topology of the machine and handle positions.

An exercise machine is affixed to a support structure 101, and comprises one or more rails 102 extending substantially the length of the machine between the stationary platform at a first end 104 and stationary platform at a second end 105. An exercise platform 103 is slidable upon the rails 102 between the first end 104 and second end 105. A spring biasing means not shown, when attached between the slidable platform and one end of the machine, provides for a resistance force to be exerted upon the slidable carriage against which an exerciser must work to overcome, therefore sliding the platform 103 in a direction opposed to the spring bias.

One pair of handles 114 is shown at a first end 104 of the machine, the central axis of the handles 114 being substantially aligned with the longitudinal axis of the machine, and a top surface substantially aligned with, but positioned at a vertical dimension above the horizontal plane of the exercise platforms 103, 104, 105.

A more complex assembly of a plurality of handles is shown at a second end 105, positioned substantially on the right and left side of a second stationary platform 105. For reference, only the fifth pair of handles 111 is described for efficiency, the handles 111 extending laterally with respect to the central longitudinal axis of the machine and being substantially transverse to the longitudinal axis of the machine, with a top surface substantially aligned with, but positioned at a vertical dimension above the horizontal plane of the exercise platforms 103, 104, 105.

FIG. 2 further illustrates an exemplary diagram showing a top view of an exercise apparatus with an improved platform handle system. More specifically, an exercise apparatus is shown comprising a substantially longitudinal rail structure supported by a plurality of feet, a first stationary platform substantially at a first end, a second stationary platform positioned substantially at a distal second end, and a slidable carriage slidably attached to the support structure by means of a plurality of trolley wheels not shown, and slidable substantially the length of the apparatus between the first and second stationary platforms.

A left and right platform and handle system substantially positioned at the first end of the apparatus, each handle system comprising an upper horizontal platform and handle, an upper gripping handle angled downwardly at an acute angle to the Z axis, a lower horizontal platform and handle aligned with the Y axis, a lower handle extending laterally therefrom substantially aligned with the X axis, a leg press platform, and a lower gripping handle aligned at an acute angle to the Z axis.

Figure 3:
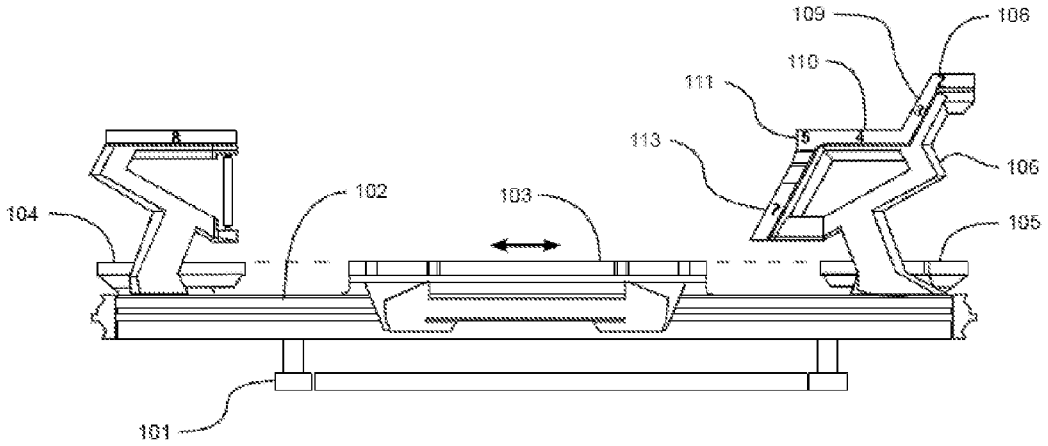
FIG. 3 is a side view of an exercise machine handle indicia system in accordance with an example embodiment.

FIG. 3 is an exemplary diagram showing a side view of an improved exercise machine comprising a support structure 101, one or more rails 102 extending substantially the length of the machine between the stationary platform at a first end 104 and stationary platform at a second end 105. An exercise platform 103 is slidable upon the rails 102 between the first end 104 and second end 105. A spring biasing means not shown, when attached between the slidable platform and one end of the machine, provides for a resistance force to be exerted upon the slidable carriage.

As can be readily understood by those skilled in the art, the vertical position of the plurality of handles varies significantly, and are purposely positioned for the performance of specific exercises as may be instructed by the trainer of a class of exercisers.

One handle of a plurality of pairs of handles are shown affixed to a handle stanchion 106 including a handle 108, the longitudinal axis of the handle being substantially aligned to the longitudinal axis of the machine, a handle 109 with the longitudinal axis of the handle being substantially vertical with respect to the horizontal plane of the exercise platforms 103, 104, 105, a handle 110 with the longitudinal axis of the handle being substantially aligned to the longitudinal axis of the machine, a handle 111 shown extending laterally with respect to the central longitudinal axis of the machine and being substantially transverse to the longitudinal axis of the machine, and a handle 113 with the longitudinal axis of the handle being substantially vertical with respect to the horizontal plane of the exercise platforms 103, 104, 105.

FIG. 3 further provides an exemplary diagram showing a side view of an exercise apparatus with an improved platform handle system. A plurality of secondary support platforms and gripping handles are shown, specifically a left and right platform and handle system positioned substantially at the second end of the apparatus with its central longitudinal axis aligned with the Y axis of the apparatus, each platform and handle system supported by a stanchion affixed to the support structure. A gripping handle with a central axis substantially aligned with the Z axis is affixed to the stanchion.

Further, a left and right platform and handle system is substantially positioned at the first end of the apparatus, each handle system supported by a stanchion comprising an upper horizontal platform and handle, an upper gripping handle with its central axis substantially aligned at an acute angle relative to the Z axis, a lower horizontal platform and handle aligned with the Y axis, a lower handle extending horizontally and laterally therefrom substantially aligned at an acute angle relative to the X axis, a leg press platform, and a lower gripping handle aligned at an acute angle to the Z axis.

As shown in FIG. 3, a first plane of the exercise apparatus indicated by the dotted horizontal line is shown comprising the top exercise surfaces of the slidable platform, a first stationary platform, and a second stationary platform. In most all instances, exercisers will engage with at least one of the platforms on the first exercise plane just described. For ease of mounting the machine, the first plane is positioned between 16.5 and 20 inches vertically above the base plane of the floor, but preferably 18 inches above the base plane (e.g. the floor surface).

As can be readily seen, at least one additional secondary horizontal exercise plane is shown extending across a pair of left and right platform and handle systems positioned proximate to a second end platform, and a pair of lower platform handles positioned proximate to a first end platform. The central axes of the platform handle just described are substantially aligned with the Y axis of the apparatus, and may be used by an exerciser to support the downward force exerted upon any of these platforms by the exerciser, for example the exerciser's hands, arms, legs or feet. Further, an exerciser may use the platform handles for stability during exercise by grasping the conformable handles by placing their hands palm-down, their thumbs on the medial side of the platform handles and fingers on the lateral side of the platform handles, and squeezing the conformable platforms to use a gripping handles.

Through experimentation and practice, it was discovered that the vertical distance between the first plane P1 and the second plane P2 should range between 15 and 17 inches, but preferably the second plane P2 is positioned approximately 16 inches vertically above the first plane P1.

Yet a another second secondary horizontal exercise plane is shown, specifically an exercise plane indicated by the dotted horizontal line labeled P3 extending across a pair of left and right upper platform handles the plane traversing substantially the width of the apparatus normal to the longitudinal axis. As previously described, the platforms may be used to support the downward pressure of the exerciser's hands, arms, legs, feet or other engaging part of the body, or maybe used as conformable gripping handles whereby the handles may be grasped by the hands in at least two different positions, one position when the alignment of the finger knuckles are aligned substantially with the X axis of the apparatus, or when the finger knuckles are aligned substantially with the Y axis of the apparatus.

Figure 4:
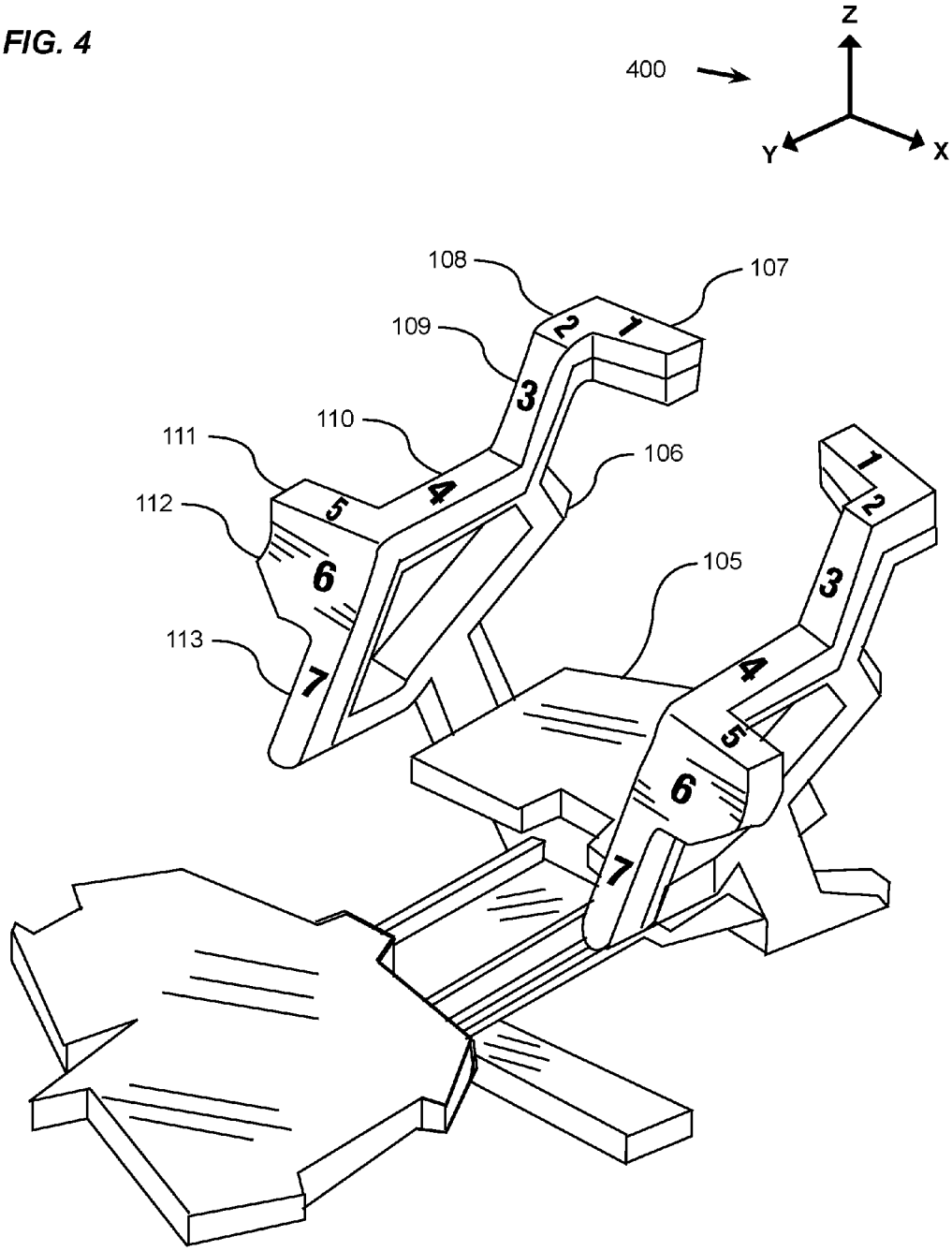
FIG. 4 is a magnified perspective view of an exercise machine handle indicia system in accordance with an example embodiment.

FIG. 4 is an exemplary diagram showing indicia on handles of an improved exercise machine. The indicia may be comprised of visual indicia that are visible to the exerciser during the performance of an exercise and/or tactile indicia physically perceptible through touch by the exerciser. The visual indicia may be comprised of colors, patterns, shapes, characters, numbers, letters, words, symbols, marks, objects, logos or any combination thereof. The visual indicia may have the same or different colors. The tactile indicia may be comprised of patterns (raised and/or lowered patterns), shapes, characters, numbers, letters, words, symbols, marks, objects, logos or any combination thereof. The indicia may also be comprised of the combination of visual indicia and tactile indicia. For example, the indicia may be comprised of different colored letters that are raised above the surface of the handles of the exercise machine to provide both a visual and tactile representation to the exerciser as to where to place their hands (or other body part such as feet). The indicia on the first handle may mirror the indicia on the second handle as shown in FIGS. 1, 2, 4 and 5 of the drawings. Alternatively, the indicia on the first handle and the second handle may be different from one another. Indicia numbers are shown on the various handles, specifically indicia numbers 1 through 7, although any alpha or numeric indicators may be used as a means of providing for an exerciser to easily identify each of the pairs of handles. Depending on the exercise selected by a trainer, the trainer will instruct an exerciser or class of exercisers to place their hands on a specific handle or pair of handles appropriate for the exercise.

As can be seen, the elevation of the handles, and the primary axis of the handles change. For instance, the first handle 107 with an indicia number "1" has a longitudinal axis providing for the axis of the exerciser's natural palm to align primarily along the X axis as indicated by the 3-dimensional axis reference diagram 400. A second handle 108 with an indicia number "2" at substantially the same elevation as handle 107 has a longitudinal axis providing for the axis of the exerciser's natural palm to align primarily along the Y axis. A third handle 109 with an indicia number "3" has a longitudinal axis providing for the axis of the exerciser's natural palm to align primarily along the Z axis, and is positioned at a lower elevation than the previously described handles. A forth handle 110 with an indicia number "4" has a longitudinal axis providing for the axis of the exerciser's natural palm to align primarily along the Y axis, and is positioned at a lower elevation than the previously described handles. At substantially the same elevation, a fifth handle 111 with an indicia number "5" has a longitudinal axis providing for the axis of the exerciser's natural palm to align primarily along the X axis. A sixth handle 112 with an indicia number "6" forms a surface with a plane substantially aligned along the X-Z plane, and may be used as a pushing handle. A seventh handle 113 with an indicia number "7" has a longitudinal axis providing for the axis of the exerciser's natural palm to align primarily along the Z axis, and is positioned at a lower elevation than the previously described handles.

Those skilled in the art will immediately appreciate the importance of an exerciser to grip the correct handle appropriate for any given exercise as a means of avoiding injury, and to further realize the maximum benefit from performing an exercise correctly, and in accordance with the instructions of the trainer.

Figure 5:
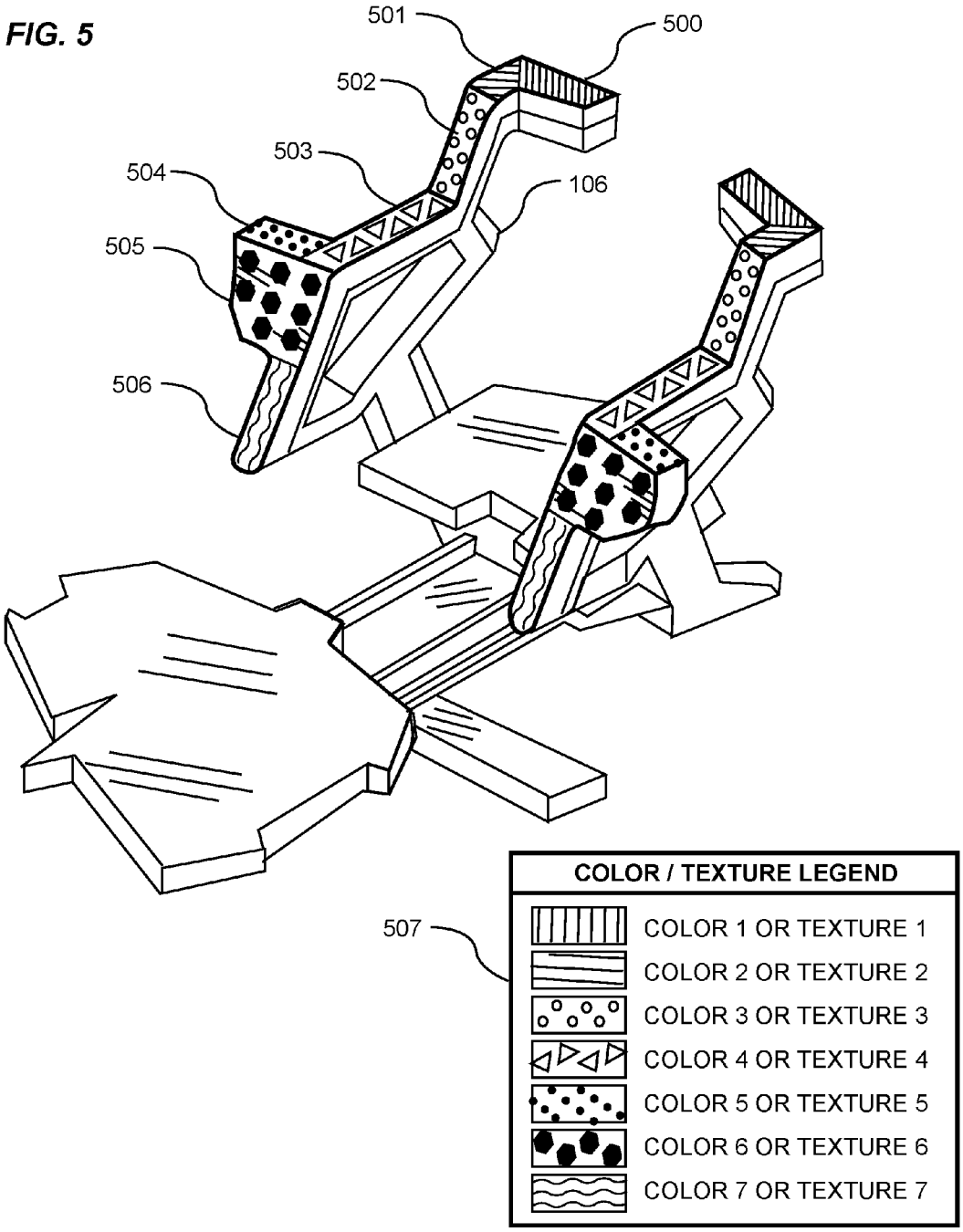
FIG. 5 is a magnified perspective view of an exercise machine handle indicia system in accordance with an example embodiment.

FIG. 5 is an exemplary diagram showing alternative indicia on handles of an improved exercise machine. The object of the present invention is to provide an exerciser the means of readily identifying each handle so as to be able to grasp the correct handle as instructed by the trainer. Therefore, indicia is not limited to the marking of the handles with an alpha or numeric character.

More specifically, in the drawing, a first handle 500 is shown with a cross striped surface, a second handle 501 is shown with a cross striped surface with striped running perpendicular to the first surface just described. A third handle surface 502 is shown with a plurality of circles, a fourth handle surface 503 is shown with a pattern of triangles, a fifth handle surface 504 is shown with a pattern of small dots, a sixth handle surface 505 is shown with a pattern of big dots, and a seventh handle surface 506 is shown with a pattern of wavy lines.

In the legend 507, each of the indicia patterns just described may designate a different color, a different surface texture, or a combination of texture or color, so long as the indicia provides for ready identification of a particular handle that should be gripped by an exerciser as may be instructed by a trainer.

It should be noted that each of the surfaces of each of the handles comprising each pair of handles may incorporate indicia that comprises one or more of the indicia just described including a unique alpha character, a unique numeral, an alpha-numeric indicator, a unique surface texture, and/or a unique color.

Figure 6:
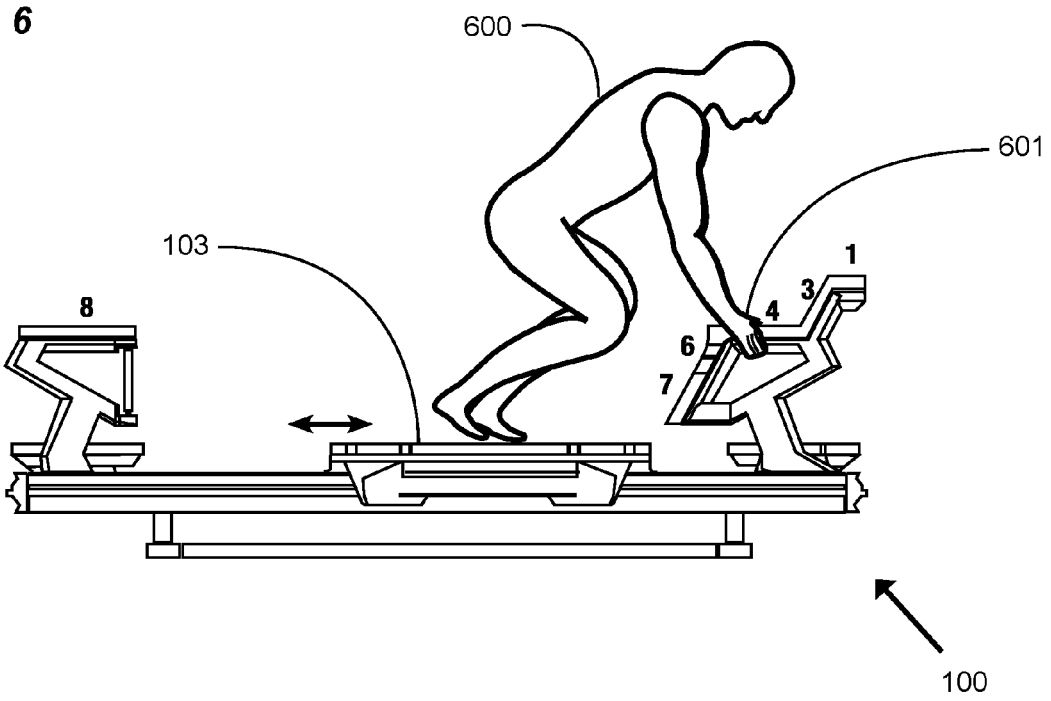
FIG. 6 is a side view of an exercise machine handle indicia system with an exerciser grasping a first set of handles in accordance with an example embodiment.

FIG. 6 is an exemplary diagram showing a side view of an exerciser 600 gripping a first set of handles of an improved exercise machine 100. As a means to provide clarity as to what indicia may be applied to which handle, indicia numerals 1 through 8 are shown proximate to the handle on which they would be applied.

As one representative example illustrating how an exerciser may grip handles during an exercise, the drawing shows an exerciser 600 in a standing position upon the slidable exercise platform 103 of an improved exercise machine 100. In practice, the exerciser 600 would be instructed to grip handles with the indicia being the numeral "4" with the axis of the palms of the hands 601 substantially aligned with the longitudinal axis of the machine 100. The handles with the indicia numeral "4" therefore provide for the best stability for the exercise about to be performed, and further ensure that the appropriate arm, shoulder, chest and back muscles will be engaged when the palms are facing each other. Ambiguity as to which handle to grip, and the likelihood of injury related to gripping the incorrect handle are minimized when the exerciser 600 grips the specific handles with the correct indicia as instructed by the trainer.

Figure 7:
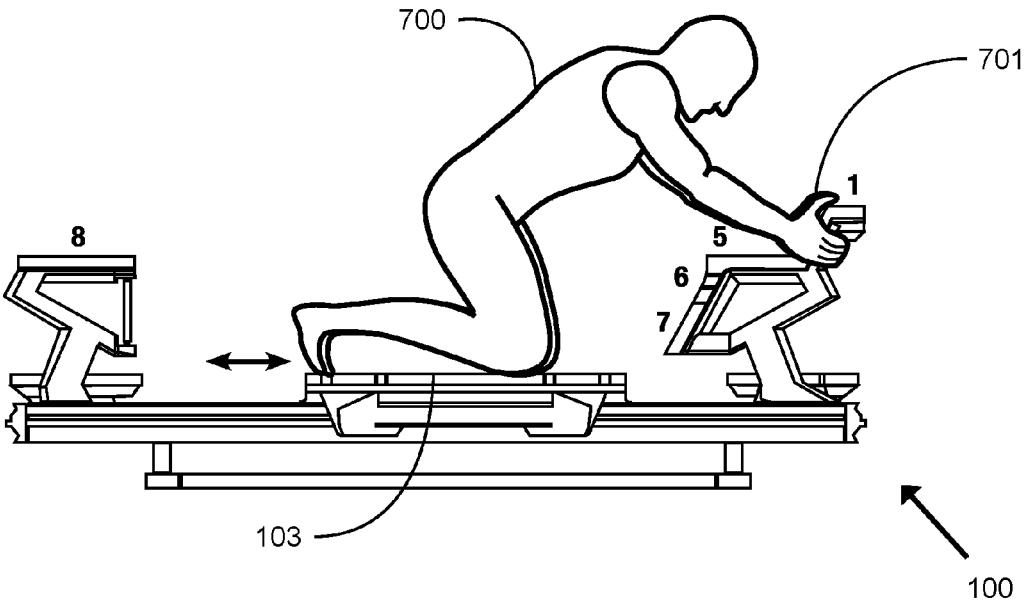
FIG. 7 is a side view of an exercise machine handle indicia system with an exerciser grasping a second set of handles in accordance with an example embodiment.

FIG. 7 is an exemplary diagram showing a side view of an exerciser 700 gripping a second set of handles of an improved exercise machine 100. As a means to provide clarity as to what indicia may be applied to which handle, indicia numerals 1 through 8 are shown proximate to the handle on which they would be applied.

As another representative example illustrating how an exerciser may grip handles during a different exercise, the drawing shows an exerciser 700 in a kneeling position upon the slidable exercise platform 103 of an improved exercise machine 100. In practice, the exerciser 700 would be instructed to grip handles with the indicia being the numeral "3" with the axis of the palms of the hands 701 aligned with a substantially vertical axis of handle number three.

As can readily be appreciated, once again, any ambiguity as to which handle to grip, and the likelihood of injury related to gripping the incorrect handle are minimized when the exerciser 700 grips the specific handles with the correct indicia as instructed by the trainer.

Figure 8:
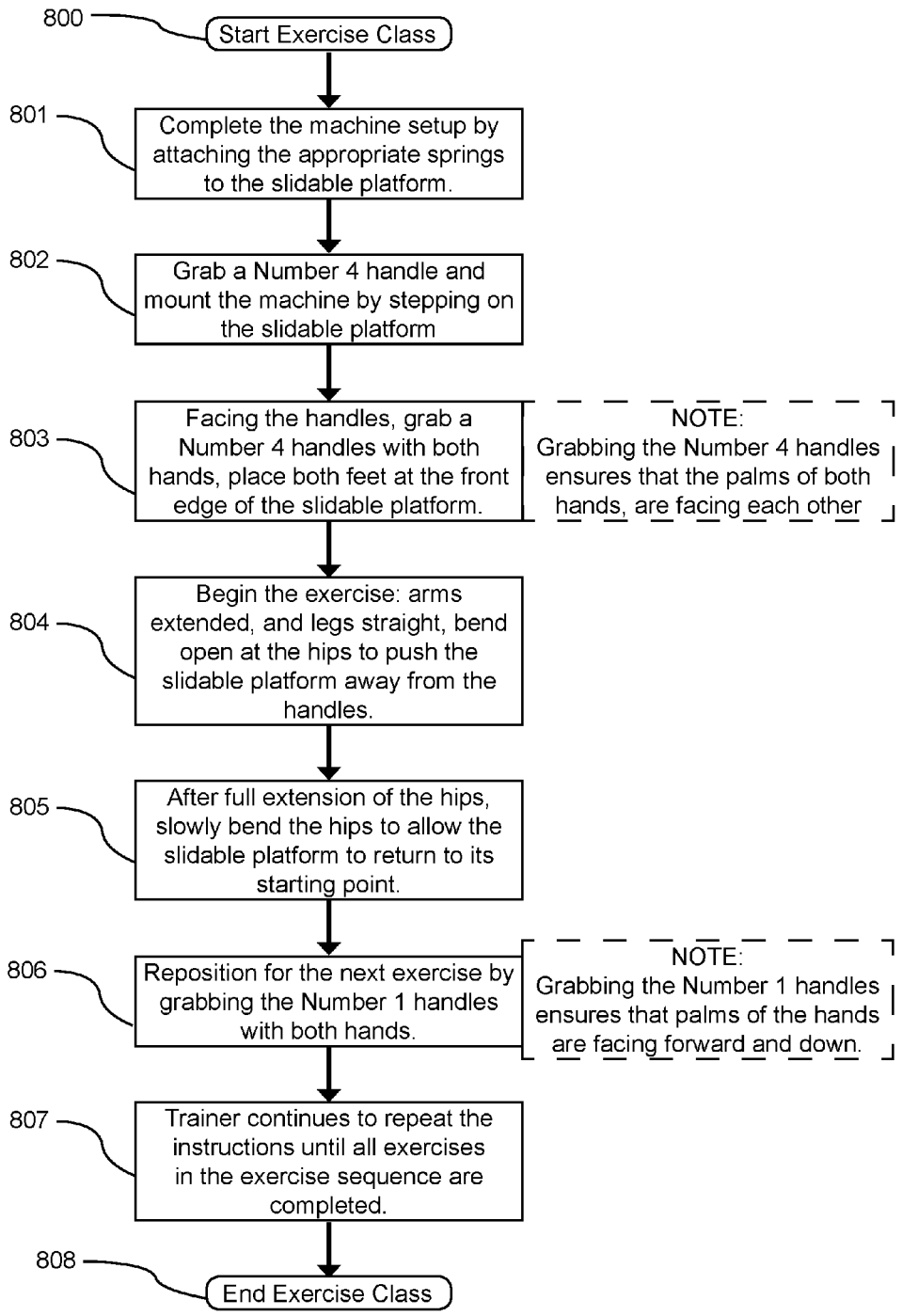
FIG. 8 is a flowchart showing a method of instructing exercisers on an exercise machine with handle indicia in accordance with an example embodiment.

FIG. 8 is an exemplary block flow diagram showing a method of instructing exercisers on an improved exercise machine. It should be noted that the number and types of different exercises that may be performed on the improved exercise machine number many hundreds, and the number of different exercise routines of thirty to forty minutes that incorporate any number of different exercises in various sequences can reach into the many thousands. Therefore, to provide a flow diagram for every possible exercise or combination of exercises comprising an exercise routine would be exhaustive and burdensome. Therefore, the drawing illustrates an example of the method of using the indicia as an integral component of instructing exercisers performing exercises on the improved exercise machine.

At the start of an exercise class 800, exercisers complete the machine setup 801 by selecting the resistance level. This is accomplished by attaching the preferred number of resistance springs between the stationary structure and the slidable platform.

In the representative exercise routine, the trainer instructs exercisers to first grip the Number 4 handle 802, the handle indicia being used to identify the preferred handle. Understanding that the exercise requires the palms of the hands to be facing one another, the instructor dutifully understands that gripping the number 4 handles will ensure that each of the exerciser's palms will be facing each other at the start of the exercise.

Once exercisers are properly positioned upon the exercise machine, the trainer then directs the exercisers to perform the exercise 804, and to return to the starting point of the exercise 805, thereby completing one repetition of the exercise. Not shown, the trainer may instruct the exercisers to repeat the process just described in 804, 805 a multiple of times before readying to change to a new and different exercise.

The trainer then instructs the exercisers to reposition for the next exercise by gripping the handles identified by the indicia "numeral 1" 806. It should be noted that the axis of the palms of the hands when gripping the instant handles change considerably from the axis of the palms of the hands while gripping the handles indicated by indicia "numeral 4", thereby eliminating potential injury to the hands, wrists, arms or shoulders in the current exercise by maintaining the grip on the handles of the previous exercise.

As can readily be appreciated, the trainer may continue to issue new instructions to the exercisers 807 throughout the duration of the workout session, providing reference to the indicia related to the handles what the exercisers should grasp each time a new exercise is introduced, the referenced indicia being one or more of a unique alpha character, a unique numeral, an alpha-numeric indicator, a unique surface texture, and/or a unique color. Upon completing the exercise session, the trainer instructs the exercisers to stop exercising 808. As can readily be appreciated, once again, any ambiguity as to which handle to grip, and correspondingly, the likelihood of injury related to gripping the incorrect handle are minimized when the exerciser grips the specific handles with the correct indicia as Instructed by the trainer.

As shown in FIGS. 1 through 3, 6 and 7 of the drawings, the exercise machine with handle indicia includes a frame having a first end, a second end and one or more rails extending between the first end and the second end. If two or more rails are used for the frame, the rails are preferably parallel to one another. As further shown in FIGS. 1 through 3, 6 and 7 of the drawings, the exercise machine further includes a carriage having an upper surface, a first end, a second end opposite of the first end, a first side and a second side opposite of the first side. The carriage is movably positioned upon the rail of the frame and is movable between the first end and the second end of the frame. The exercise machine further preferably includes one or more bias members (e.g. springs, tension springs, elastic bands, electromagnetic resistance devices, hydraulic actuators, etc.) connected between the carriage and the frame that apply a bias force upon the carriage which creates an resistance force for the exerciser performing an exercise on the exercise machine by moving the carriage.

The exercise machine preferably includes a first end platform connected to the frame and positioned near the first end of the frame. The exercise machine further preferably includes a second end platform connected to the frame and positioned near the second end of the frame opposite of the first end platform as illustrated in FIGS. 1 through 3 of the drawings.

As shown in FIGS. 1, 2, 4 and 5 of the drawings, a first handle and a second handle are connected to the frame near the first end of the frame. The first handle and the second handle are used by an exerciser using the exercise machine to grasp with their hands before and during the performance of an exercise. The handles may have various structures and configurations other than illustrated in FIGS. 1 through 7 of the drawings. For example, the handles may be comprised of an inverted L-shaped structure or other structure used for grasping with the hands of the exerciser.

The first handle includes a first indicia to indicate where to position a first hand of an exerciser to perform a first exercise. The first handle preferably includes a second indicia to indicate where to position the first hand of an exerciser to perform a second exercise. The first handle further preferably includes a third indicia to indicate where to position the first hand of an exerciser to perform a third exercise. The second handle includes a first indicia to indicate where to position a second hand of the exerciser to perform the first exercise. The second handle preferably includes a second indicia to indicate where to position the second hand of the exerciser to perform the second exercise. The second handle further preferably includes a third indicia to indicate where to position the second hand of the exerciser to perform the third exercise.

The first indicia and the second indicia are preferably comprised of visual indicia but may be comprised of tactile indicia or a combination of visual indicia and tactile indicia. For example, the first indicia of the first handle and the second handle may be comprised of the same or different color, the same or different character, the same or different pattern, the same or different visual representation, or the same or different shape. It is preferable, but not required, that the first indicia of the first handle correspond to the first indicia of the second handle in both location and type of indicia used. To further the example, the second indicia of the first handle and the second handle may be comprised of the same or different color, the same or different character, the same or different pattern, the same or different visual representation, or the same or different shape. As with the first indicia, it is preferable, but not required, that the second indicia of the first handle correspond to the first indicia of the second handle in both location and type of indicia used.

As can be appreciated, the number of indicia on the handles is only limited by the amount of physical space on the handles and the number of exercise positions needed to perform a corresponding number of exercises. For example, FIGS. 1, 2 and 4 illustrate the usage of seven different indicia comprised of seven different numbers positioned in seven different locations on each of the handles. The total number of indicia for each handle may be greater than or less than the seven indicia shown in FIGS. 1, 2 and 4 of the drawings. Furthermore, the indicia may be positioned on the top, side, front and/or rear surface of the handles. As another example, the indicia may be comprised of the different segments of the handles having different colors (e.g. the segment marked with numbers 1 and 2 may be the color red, the segment marked with the number 3 may be the color blue, the segment marked with the numbers 4 and 5 may be the color orange, and the segment marked with the numbers 6 and 7 may be yellow). Numerous combinations and types of indicia may be used for the handles.

The location of the first indicia on the first handle preferably mirrors the location of the first indicia on the second handle (e.g. reference numeral 1 of the first handle corresponds to the location of reference numeral 1 of the second handle and so forth). In addition, the location of the second indicia on the first handle preferably mirrors the location of the second indicia on the second handle. The location of the third indicia on the first handle also preferably mirrors the location of the third indicia on the second handle. While it is preferred that all of the indicia that correspond with one another between the two handles mirror the respective position of one another, it can be appreciated that the first indicia for the first handle and the second handle may have different locations on their respective handles.

To perform an exercise on the exercise machine, first instructions are communicated to the exerciser (e.g. by an instructor, electronic device such as computer or audio/visual device, etc.). The first instructions provide directions to the exerciser to position the first hand on the first indicia of the first handle and the second hand on the first indicia of the second handle relating to the first exercise. For example, the first instructions may be an verbal instruction from an instructor to one or more students stating "Position your left and right hands on the number 4 of your handles" or "Position your left hand on the number 4 of the left handle and position your right hand on the number 4 of the right handle". The instructions may also be a visual display screen (e.g. television screen, computer screen, portable electronic device, smart phone, etc.) that displays the instructions on where to position their hands (or other body part) on the exercise machine). Many different variations of instructions may be used to instruct the class of exercisers. After the exerciser positions their hands in the proper location on the handles of the exercise machine and any other body part in another location (e.g. the carriage) for the first exercise, the exerciser then performs the first exercise which may involve pushing and/or pulling the carriage away/towards the handles as illustrated in FIGS. 6 and 7 of the drawings.

After the first exercise is performed, second instructions are communicated to the exerciser which provide directions to the exerciser to position the first hand on the second indicia (e.g. number 2) of the first handle and the second hand on the second indicia (e.g. number 2) of the second handle relating to the second exercise. After the exerciser positions their hands in the proper location on the handles of the exercise machine and any other body part in another location (e.g. the carriage) for the second exercise, the exerciser then performs the second exercise which may involve pushing and/or pulling the carriage away/towards the handles as illustrated in FIGS. 6 and 7 of the drawings.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine handle indicia system, suitable methods and materials are described above. All publications, patent applications, patents, and other references mentioned herein are incorporated by reference in their entirety to the extent allowed by applicable law and regulations. The exercise machine handle indicia system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine with handle indicia, comprising:

a frame having a first end, a second end and a rail extending between the first end and the second end;

a carriage having an upper surface, a first end, a second end opposite of the first end, a first side and a second side opposite of the first side, wherein the carriage is movably positioned upon the rail of the frame, and wherein the carriage is movable between the first end and the second end;

a bias member connected between the carriage and the frame that applies a bias force upon the carriage;

a first end platform connected to the frame and positioned near the first end of the frame;

a second end platform connected to the frame and positioned near the second end of the frame; and a first handle and a second handle connected to the frame near the first end of the frame;

wherein the first handle and the second handle each include a plurality of surfaces at different angles configured to simultaneously support multiple surfaces of the exerciser, wherein the first support structure and the second support structure are each configured to provide a plurality of locations to grasp by the exerciser;

wherein the first handle includes a first indicia to indicate where to position a first hand of an exerciser to perform a first exercise;

wherein the second handle includes a first indicia to indicate where to position a second hand of the exerciser to perform the first exercise.

2. The exercise machine with handle indicia of claim 1, wherein the first indicia of the first handle and the second handle are comprised of visual indicia.

3. The exercise machine with handle indicia of claim 2, wherein the first indicia of the first handle and the second handle are comprised of the same color.

4. The exercise machine with handle indicia of claim 2, wherein the first indicia of the first handle and the second handle are comprised of a character.

5. The exercise machine with handle indicia of claim 4, wherein the first indicia of the first handle and the second handle are comprised of the same character.

6. The exercise machine with handle indicia of claim 2, wherein the first indicia of the first handle and the second handle are comprised of a pattern.

7. The exercise machine with handle indicia of claim 6, wherein the first indicia of the first handle and the second handle are comprised of the same pattern.

8. The exercise machine with handle indicia of claim 2, wherein the first indicia of the first handle and the second handle are comprised of the same visual representation.

9. The exercise machine with handle indicia of claim 1, wherein the first indicia of the first handle and the second handle are comprised of tactile indicia.

10. The exercise machine with handle indicia of claim 9, wherein the first indicia of the first handle and the second handle are comprised of the same pattern.

11. The exercise machine with handle indicia of claim 9, wherein the first indicia of the first handle and the second handle are comprised of the same character.

12. The exercise machine with handle indicia of claim 1, wherein the first indicia of the first handle and the second handle are comprised of a shape.

13. The exercise machine with handle indicia of claim 12, wherein the first indicia of the first handle and the second handle are comprised of the same shape.

14. The exercise machine with handle indicia of claim 1, wherein the first indicia of the first handle and the second handle are comprised of a character.

15. The exercise machine with handle indicia of claim 14, wherein the first indicia of the first handle and the second handle are comprised of numbers.

16. An exercise machine with handle indicia, comprising:

a frame having a first end, a second end and a rail extending between the first end and the second end;

a carriage having an upper surface, a first end, a second end opposite of the first end, a first side and a second side opposite of the first side, wherein the carriage is movably positioned upon the rail of the frame, and wherein the carriage is movable between the first end and the second end;

a bias member connected between the carriage and the frame that applies a bias force upon the carriage;

a first end platform connected to the frame and positioned near the first end of the frame;

a second end platform connected to the frame and positioned near the second end of the frame; and a first handle and a second handle connected to the frame near the first end of the frame;

wherein the first handle and the second handle each include a plurality of surfaces at different angles configured to simultaneously support multiple surfaces of the exerciser, wherein the first support structure and the second support structure are each configured to provide a plurality of locations to grasp by the exerciser;

wherein the first handle includes a first indicia to indicate where to position a first hand of an exerciser to perform a first exercise;

wherein the first handle includes a second indicia to indicate where to position the first hand of an exerciser to perform a second exercise;

wherein the second handle includes a first indicia to indicate where to position a second hand of the exerciser to perform the first exercise;

wherein the second handle includes a second indicia to indicate where to position the second hand of the exerciser to perform the second exercise.

17. The exercise machine with handle indicia of claim 16, further comprising:

wherein the first handle includes a third indicia to indicate where to position the first hand of an exerciser to perform a third exercise; and wherein the second handle includes a third indicia to indicate where to position the second hand of the exerciser to perform the third exercise.

18. The exercise machine with handle indicia of claim 17, wherein the location of the first indicia on the first handle mirrors the location of the first indicia on the second handle, wherein the location of the second indicia on the first handle mirrors the location of the second indicia on the second handle, and wherein the location of the third indicia on the first handle mirrors the location of the third indicia on the second handle.

19. The exercise machine with handle indicia of claim 16, wherein the location of the first indicia on the first handle mirrors the location of the first indicia on the second handle, and wherein the location of the second indicia on the first handle mirrors the location of the second indicia on the second handle.

20. A method of exercising on the exercise machine of claim 16, said method comprising the following steps:

communicating to the exerciser to position the first hand on the first indicia of the first handle and the second hand on the first indicia of the second handle relating to the first exercise;

performing the first exercise by the exerciser;

communicating to the exerciser to position the first hand on the second indicia of the first handle and the second hand on the second indicia of the second handle relating to the second exercise; and performing the second exercise by the exerciser.

* * * * *